US009849395B1

(12) United States Patent
Muraki

(10) Patent No.: US 9,849,395 B1
(45) Date of Patent: Dec. 26, 2017

(54) TOY TOP

(71) Applicant: TOMY COMPANY, LTD., Tokyo (JP)

(72) Inventor: Makoto Muraki, Tokyo (JP)

(73) Assignee: TOMY COMPANY, LTD., Tokyo (JP)

( * ) Notice: Subject to any disclaimer, the term of this patent is extended or adjusted under 35 U.S.C. 154(b) by 0 days.

(21) Appl. No.: 15/684,097

(22) Filed: Aug. 23, 2017

(30) Foreign Application Priority Data

Oct. 18, 2016 (JP) ..... 2016-204640

(51) Int. Cl.
*A63H 1/06* (2006.01)
*A63H 1/02* (2006.01)
*A63F 9/00* (2006.01)

(52) U.S. Cl.
CPC ..... *A63H 1/02* (2013.01)

(58) Field of Classification Search
CPC ... A63H 1/00; A63H 1/06; A63H 1/08; A63H 1/18; A63H 29/24; A63F 6/00; A63F 6/16
USPC ..... 446/256–266
See application file for complete search history.

(56) References Cited

U.S. PATENT DOCUMENTS

| | | | | |
|---|---|---|---|---|
| 3,143,347 | A * | 8/1964 | Ruderian | A63F 5/041 273/142 J |
| 6,746,300 | B1 * | 6/2004 | Matsukawa | A63H 1/06 446/256 |
| 2009/0253344 | A1 | 10/2009 | Ujita et al. | |
| 2011/0006479 | A1 | 1/2011 | Ujita et al. | |
| 2011/0171876 | A1 | 7/2011 | Ujita et al. | |
| 2011/0256795 | A1 | 10/2011 | Ujita et al. | |
| 2011/0256796 | A1 | 10/2011 | Ujita et al. | |
| 2016/0325190 | A1 | 11/2016 | Muraki et al. | |
| 2017/0203218 | A1 | 7/2017 | Muraki | |

FOREIGN PATENT DOCUMENTS

| | | |
|---|---|---|
| JP | 53-158397 | 12/1978 |
| JP | 55-45385 | 3/1980 |
| JP | 3083443 | 11/2001 |
| JP | 3088350 | 6/2002 |
| JP | 3160638 | 6/2010 |
| JP | 5969151 | 7/2016 |
| WO | 2016/119395 | 8/2016 |

OTHER PUBLICATIONS

Office Action for Japanese Patent Application No. 2016-204640, issued May 30, 2017.
Decision to Grant a Patent for Japanese Patent Application No. 2016-204640, dated Jul. 11, 2017.

* cited by examiner

*Primary Examiner* — Kien Nguyen
(74) *Attorney, Agent, or Firm* — Staas & Halsey LLP

(57) ABSTRACT

A toy top includes the following. A shaft unit has a shaft center with an axis that matches a rotational center. A shaft tip unit is provided at a lower end section of the shaft unit. The shaft tip unit includes a ring member provided in a movable manner centering around the axis and a member that comes in contact with a ground which is disposed at a center of the ring member and which protrudes downward than the ring member. The shaft unit includes a lower case which supports the shaft tip unit from below in a moveable manner and from which a lower end section of the shaft tip unit is exposed and an abutting member which abuts an upper side of the shaft tip unit.

8 Claims, 9 Drawing Sheets

TOY TOP

BACKGROUND

Field of the Invention

The present invention relates to a toy top.

Description of Related Art

Traditionally, there is suggested a toy top provided with a spherical body as a contact at the tip of the shaft unit thereof (for example, see Japanese Unexamined Utility Model Application Publication No. S55-45385).

In such case where the contact provided at the tip of the shaft unit is a spherical body, the friction resistance that occurs between the tip of the shaft unit and the field (the surface where the game takes place) can be decreased and the toy top can spin more smoothly.

In such toy top, as in the pointed tip of a ball-pointed pen, a ring member for supporting the spherical body by the section below the largest diameter section of the spherical body is provided so as to prevent the spherical body from falling downward.

However, in the case where the ring member is disposed around the spherical body, the shaft of the toy top may tilt due to the toy top being thrown in to the field in a diagonal direction or due to the toy top being bounced off by coming in contact with another toy top which is the toy top of the opponent of the battle game, for example, and the ring member may come in contact with the field.

If the ring member comes in contact with the field, the posture of the toy top whose shaft is tilted can be restored and a brake will be applied to the toy top preventing the toy top from flying out from the field. However, on the other hand, if the ring member is fixated, there is a problem that the rotational energy of the toy top will be lost due to the friction resistance that occurs between the ring member and the field being large.

Such problem is not limited to the case where the contact is a spherical body and such problem may similarly occur in cases where ring members are disposed around contacts regardless of the shapes of the tips of the contacts.

SUMMARY

The present invention is made in view of the above problem and an object is to provide a toy top having a configuration that can control the rotational energy loss while ensuring the brake performance.

According to an aspect of the present invention, there is provided a toy top, including: a shaft unit whose shaft center is an axis that matches a rotational center; and a shaft tip unit which is provided at a lower end section of the shaft unit, the shaft tip unit including a ring member provided in a movable manner centering around the axis and a member that comes in contact with a ground which is disposed at a center of the ring member and which protrudes downward than the ring member, wherein the shaft unit includes: a lower case which supports the shaft tip unit from below in a moveable manner and from which a lower end section of the shaft tip unit is exposed; and an abutting member which abuts an upper side of the shaft tip unit.

BRIEF DESCRIPTION OF THE DRAWINGS

The present invention will become more fully understood from the detailed description given hereinbelow and the appended drawings, and thus are not intended to define the limits of the present invention, and wherein.

DESCRIPTION OF THE PREFERRED EMBODIMENTS

Figure 1A:
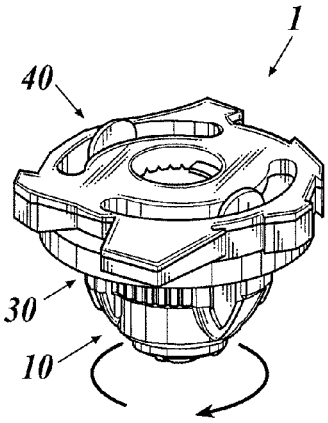
FIG. 1A is a perspective view showing an embodiment of a toy top according to the present invention.

Hereinafter, an embodiment of the toy top according to the present invention will be described with reference to FIGS. 1A and 1B to FIG. 9.

Here, although various limitations which are technically preferable to carry out the present invention are described in the following embodiment, the invention is not limited to the embodiment and the examples shown in the drawings.

<Overall Configuration>

Figure 1B:
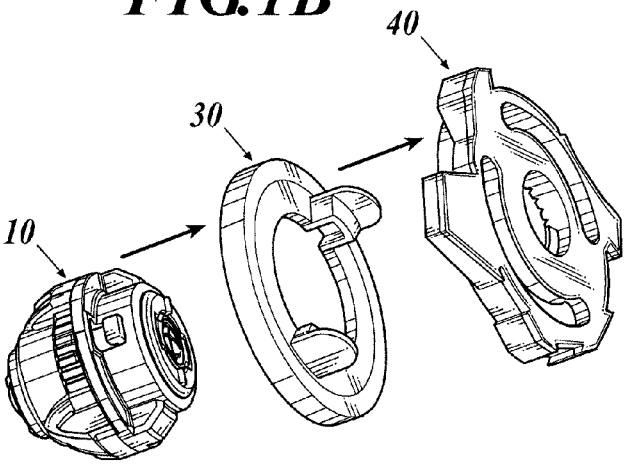
FIG. 1B illustrates how to play with the toy top according to the embodiment.
Figure 2:
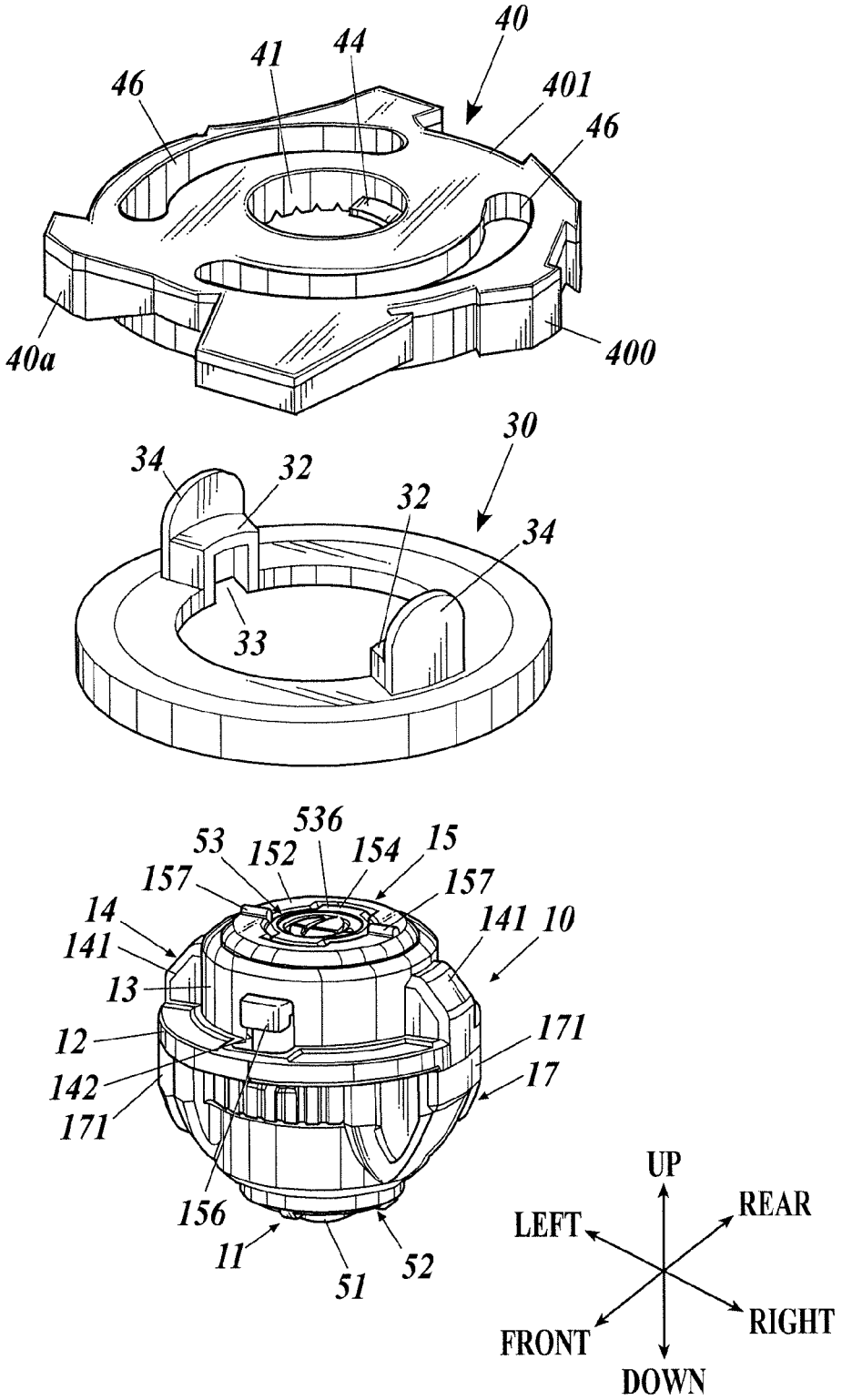
FIG. 2 is an exploded perspective view of the toy top according to the embodiment.

FIG. 1A is a perspective view showing an embodiment of a toy top according to the present invention, FIG. 1B illustrates how to play with the toy top according to the embodiment, and FIG. 2 is an exploded perspective view of the toy top according to the present invention.

Here, in the present description, the up and down directions, left and right directions and front and rear directions are the directions indicated in FIG. 2.

The toy top 1 of the embodiment is a toy top which can be used in a so-called toy top battle game.

Specifically, the toy top 1 can be used in a battle game where whoever makes the opponent's toy top 1 disassembled as shown in FIG. 1B by the impact force of the collision of the two toy tops is the winner of the game.

As shown in FIGS. 1B and 2, the toy top 1 includes a shaft unit 10 which forms the lower structure and which is the driver, a performance changing ring 30 and a body 40 which are layers that form the upper structure.

<Detail Configuration>

1. Shaft Unit 10

Figure 3A:
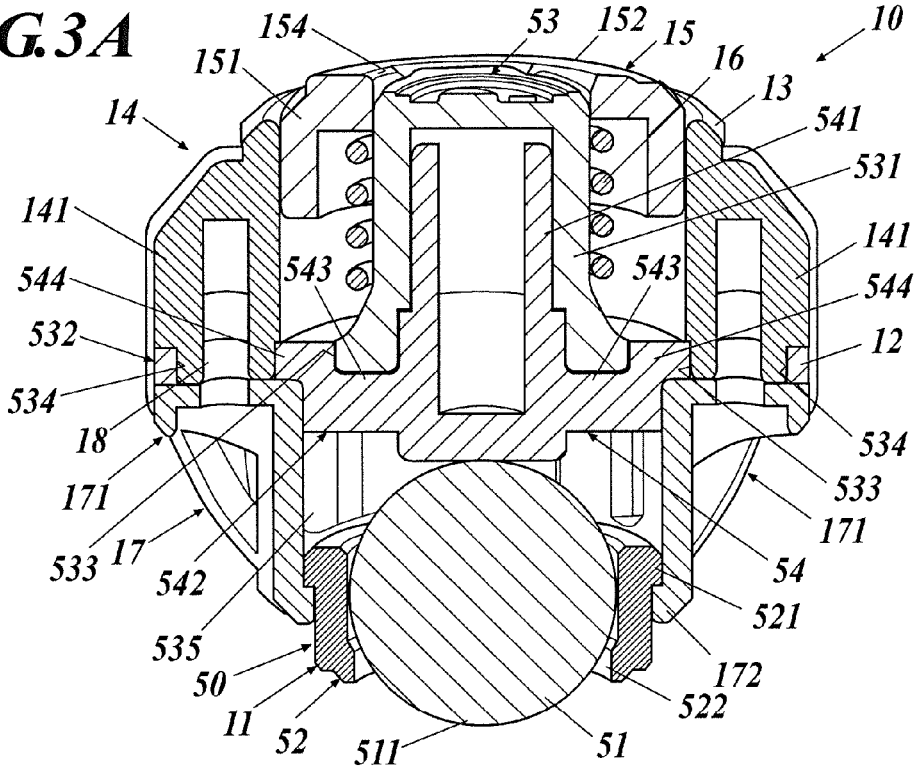
FIG. 3A is a cross-sectional perspective view where a shaft unit of the toy top of the embodiment is cut along the left-right direction.
Figure 3B:
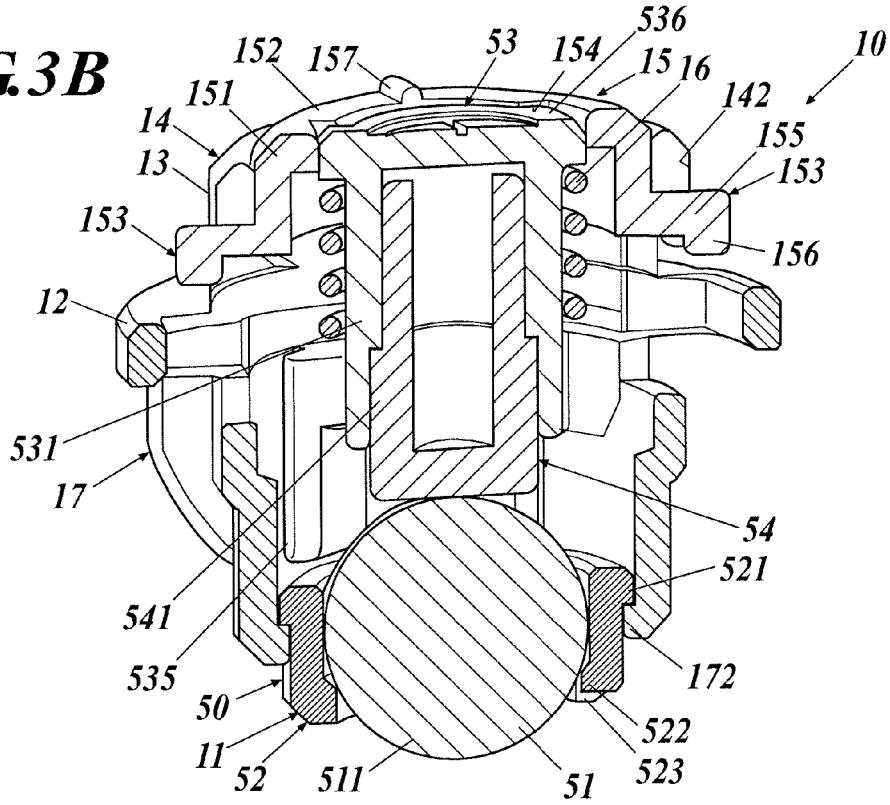
FIG. 3B is a cross-sectional perspective view where the shaft unit of the embodiment is cut along the front-rear direction.

FIG. 3A is a cross-sectional perspective view where the shaft unit of the toy top of the embodiment is cut along the left-right direction of FIG. 2, and FIG. 3B is a cross-sectional perspective view where the shaft unit of the toy top of the embodiment is cut along the front-rear direction of FIG. 2.

Figure 4:
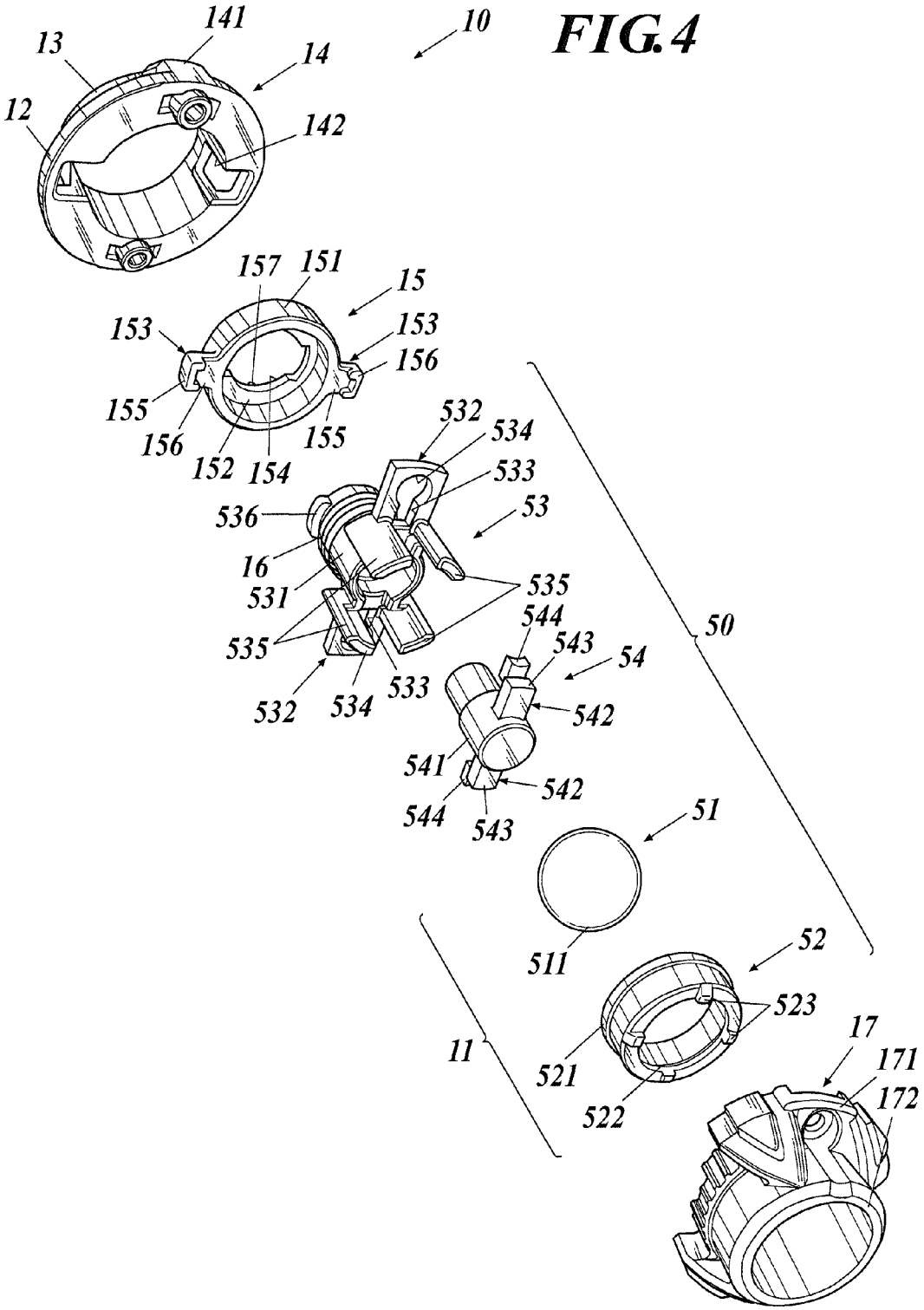
FIG. 4 is an exploded perspective view of the shaft unit of the toy top.

Further, FIG. 4 is an exploded perspective view of the shaft unit of the embodiment.

As shown in FIG. 2, the shaft center of the shaft unit 10 is the axis which matches the rotation center of the toy top 1 and the shaft unit 10 includes a shaft tip unit 11 at the lower end section, a flange 12 at the center section in the up-down direction and a cylinder 13 at the upper section.

As shown in FIG. 4, the flange 12 and the cylinder 13 integrally form the upper case 14 and form the upper section of the shaft unit in the embodiment.

As shown in FIGS. 3A and 4, at the cylinder 13 and the flange 12 of the upper case 14, protrusions 141 are respectively formed at two positions facing each other in the left-right direction having the axis of the shaft unit 10 therebetween. The outer surfaces of the protrusions 141 are substantially flat with relation to the outer surface of the flange 12.

Further, as shown in FIGS. 3B and 4, at the cylinder 13 and the flange 12 of the upper case 14, holes 142 are respectively formed at two positions facing each other in the front-rear direction having the axis of the shaft unit 10 therebetween. The holes 142 extend along the axis of the shaft unit 10.

The shaft unit 10 further includes a pressing member 15 which is formed in an approximately cylinder shape. Although the pressing member 15 is made of synthetic resin in the embodiment, the pressing member 15 may be made of metal or the like.

Figure 5A:
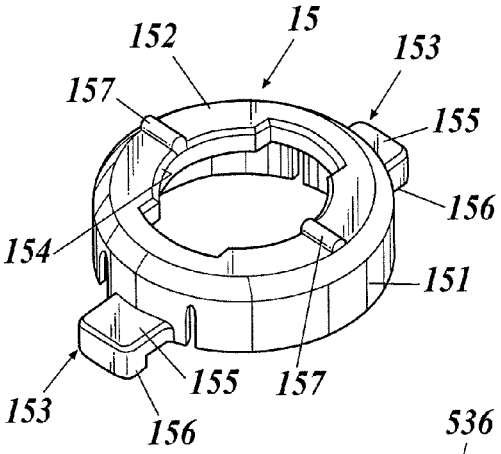
FIG. 5A is a perspective view of a pressing member of the toy top.

FIG. 5A is a perspective view when the pressing member 15 is looked down diagonally.

As shown, in FIGS. 3B, 4 and 5A, the pressing member 15 includes a cylinder 151, a ceiling 152 and legs 153.

The outer diameter of the cylinder 151 is smaller than the inner diameter of the cylinder 13 of the upper case 14, and the cylinder 151 of the pressing member 15 is disposed in the cylinder 13 of the upper case 14 when assembled.

Further, the inner diameter of the cylinder 151 is larger than the outer diameter of the upper end section of the after-mentioned first pillar member 53 of the shaft main body 50, and the upper end section of the first pillar member 53 is fit in the cylinder 151.

The ceiling 152 is formed at the upper end of the cylinder 151. The ceiling 152 has a hole 154 having a shape that corresponds to the upper end section of the first pillar member 53 formed therein.

Further, the legs 153 are formed at the lower end section on the outer circumference of the cylinder 151.

The legs 153 are formed at two positions on the outer circumference of the cylinder 151 that face each other in the front-rear direction having the axis of the shaft unit 10 therebetween. Each leg 153 includes a horizontal part 155 which protrude horizontally from the cylinder 151 and a vertical part 156 which extend vertically downward from the tip of the horizontal part 155.

The pressing member 15 which is configured as described above is set so that the legs 153 are inserted in the holes 142 of the upper case 14 when assembled. The size of the holes 142 in the up-down direction is set to be larger than the length of the legs 153 and the legs 153 are respectively guided in the up and down directions in the holes 142 so that the pressing member 15 can move in the up and down directions along the axis of the shaft unit 10.

The pressing member 15 is biased in the upper direction by a spring 16. The pressing member 15 is restricted from moving upward due to the legs 153 abutting the upper edges of the holes 142 and in the normal state, the upper edge of the pressing member 15 is disposed at approximately the same height as the upper edge of the cylinder 13 of the upper case 14.

Further, on the upper surface of the ceiling 152 of the pressing member 15, ridges (protrusions) 157 which extend in the radius direction are formed at two positions that face each other in the left-right direction having the axis of the shaft unit 10 therebetween.

The lower section of the shaft unit 10 is provided with a lower case 17 which forms the lower section of the shaft unit, which supports the after-mentioned shaft tip unit 11 from below in a movable manner and from which the lower end part of the shaft tip unit 11 is exposed.

Figure 5B:
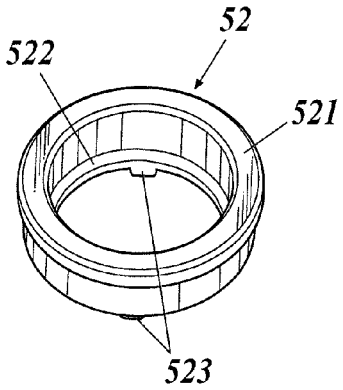
FIG. 5B is a perspective view of a ring member of the toy top.
Figure 5C:
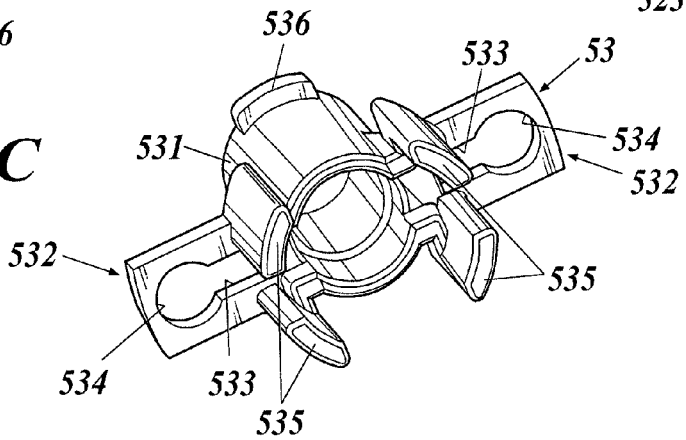
FIG. 5C is a perspective view of the first pillar member of the toy top.
Figure 5D:
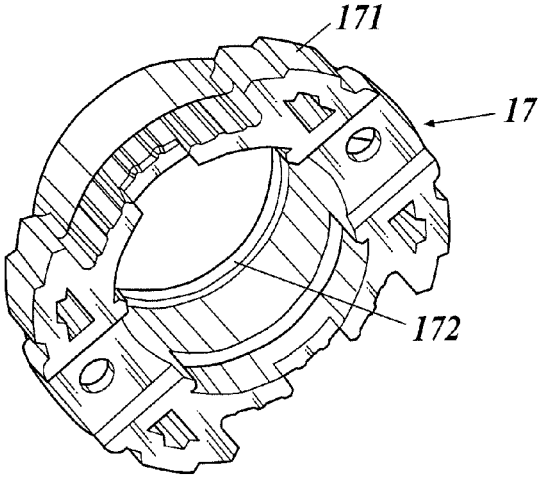
FIG. 5D is a perspective view of a lower case of the toy top.

FIG. 5D is a perspective view of the lower case 17 of the embodiment.

As shown in FIGS. 4 and 5D, the upper end and the lower end of the lower case 17 which forms the lower section of the shaft unit are opened and the lower case 17 is formed in a shape where the diameter becomes gradually smaller as approaching the shaft tip unit 11 side from the flange 12 side. As a whole, the lower case 17 is formed in an approximately hemispherical shape or in an approximately reversed cone shape.

As shown in FIGS. 2 and 4, the lower case 17 has protrusions 171 which protrude outward in the radius direction formed at the positions corresponding to the protrusions 141 of the upper case 14.

The upper section of the shaft unit and the lower section of the shaft unit are integrated by fixating the flange 12 and the cylinder 13 of the upper case 14 which form the upper section of the shaft unit to the lower case 17 which forms the lower section of the shaft unit with screws 18 at the positions corresponding to the protrusions 141 and 171.

Further, at the edge of the opening on the lower side of the lower case 17, an inside flange 172 which protrudes inward of the lower case 17 is formed.

The inner diameter of the inside flange 172 is smaller than the outer diameter of the flange 521 of the after-mentioned ring member 52, and the under surface of the flange 521 of the ring member 52 abuts the upper surface of the inside flange 172 so that the lower case 17 supports the ring member 52 which forms the shaft tip unit 11 from below to prevent the ring member 52 from falling. Further, in the state where the under surface of the flange 521 abuts the upper surface of the inside flange 172, the ring member 52 which forms the shaft tip unit 11 and the lower end section of the spherical body 51 which is the member that comes in contact with the ground are exposed from the opening at the bottom of the lower case 17.

In the space formed by the upper case 14 and the lower case 17, the shaft unit main body 50 whose shaft center is the axis that matches the rotation center of the toy top 1 is disposed.

Figure 6A:
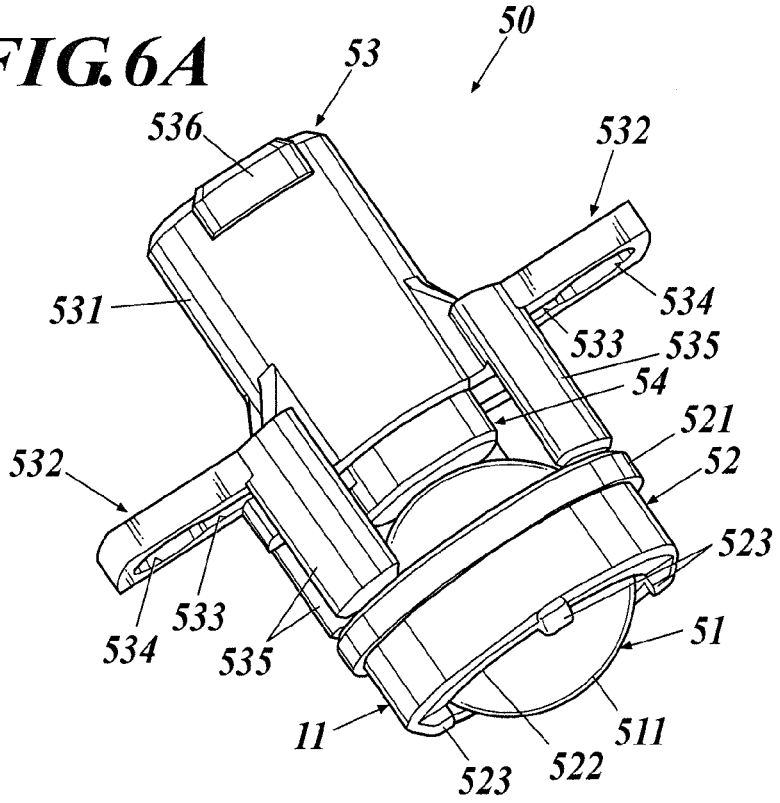
FIG. 6A is a perspective view of a shaft unit main body of the toy top.
Figure 6B:
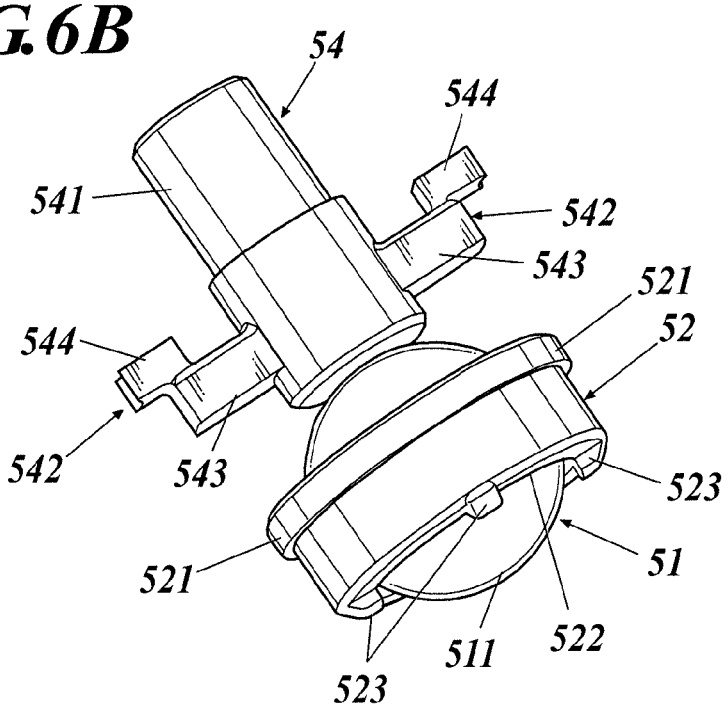
FIG. 6B is a perspective view illustrating a state where the first pillar member is detached from the shaft unit main body shown in FIG. 6A.

FIG. 6A is a perspective view of the shaft unit main body and FIG. 6B is a perspective view illustrating the inner structure where the first pillar member is removed from the shaft unit main body shown in FIG. 6A.

As shown in FIGS. 4, 6A and 6B, the shaft unit main body 50 includes the shaft tip unit 11, the first pillar member 53 and the second pillar member 54.

In the embodiment, the shaft tip unit 11 is formed of the member that comes in contact with the ground and the ring member 52.

That is, the shaft tip unit 11 is provided at the lower end section of the shaft unit 10 and the shaft tip unit 11 includes the ring member 52 which rotates freely centering around the axis and the member that comes in contact with the ground which is disposed at the center of the ring member 52 and whose tip, at least, protrudes downward than the ring member 52.

The member that comes in contact with the ground is the part which directly comes in contact with the field or the like when playing with the toy top 1 and in the embodiment, the member that comes in contact with the ground includes an arc unit 511 which protrudes downward than the ring member 52. More specifically, the member that comes in contact with the ground of the embodiment is the spherical body 51 which is formed to have the largest diameter at the center section thereof.

The spherical body 51 is a metallic ball, for example. Here, the material used for the spherical body 51 is not limited to metal and for example, the spherical body 51 can be made of a hard resin or the like, for example.

Although the size of the spherical body 51 is not specifically limited, the larger the diameter of the spherical body 51, the easier to stabilize the posture of the toy top 1 when it is about to fall.

FIG. 5B is a perspective view of the ring member 52.

The ring member 52 is a ring member which holds the spherical body 51 so as to rotate freely by supporting the lower section of the spherical body 51, which is the section of the spherical body 51 on the lower side of the center section in the up-down direction.

That is, in the embodiment, the diameter at the center section of the spherical body 51 is the largest diameter and the ring member 52 supports the spherical body 51 by the lower section thereof, the lower section being on the lower side of the section having the largest diameter, so that the spherical body 51 does not fall downward from the ring member 52.

Specifically, as shown in FIGS. 4 and 5B, the ring member 52 is a cylindrical member whose upper end and lower end are opened, and the ring member 52 is provided with a flange 521 which protrudes outward at the edge of the upper side opening thereof.

As described above, when assembled, the under surface of the flange 521 abuts the upper surface of the inside flange 172 of the lower case 17 and the flange 521 is supported by the lower case 17 from below so as not to fall downward.

In such way, by having the ring member 52 which supports the spherical body 51 which is the member that comes in contact with the ground, the ring member 52 comes in contact with the field or the like when the shaft unit 10 tilts by a predetermined angle or greater. Since the part of the ring member 52 that comes in contact with the field or the like is apart from the axis (rotational center) of the shaft unit 10 to a certain extent, optimum brake can be applied to the toy top 1.

Moreover, at the edge of the lower side opening of the ring member 52, the inside flange 522 which protrudes inward is formed.

The inner diameter of the inside flange 522 is smaller than the diameter of the section of the spherical body 51 having the largest diameter and when assembled, the spherical body 51 abuts the inside flange 522 and the spherical body 51 is supported by the ring member 52 so as not to fall downward.

Further, at the lower edge section of the ring member 52, protrusions 523 which protrude outward from the ring member 52 are formed.

The protrusions 523 come in contact with the field surface or the like when the axis of the shaft unit 10 tilts to a certain extent from the vertical direction. By having the protrusions 523, each protrusion 523 comes in contact with the field surface or the like as a point when the axis of the shaft unit 10 tilts. Therefore, the contact area of a protrusion 523 and the field surface can be smaller comparing to the case where the lower end section of the ring member 52 comes in contact with the field surface or the like as a surface and the rotational energy loss can be controlled to be small.

In the embodiment, a plurality of protrusions 523 are formed at the lower end section of the ring member 52 along the circumference of the ring member 52 having approximately equal intervals therebetween (as shown in FIG. 4, there are four in the embodiment).

Although the number of the protrusions 523 and the disposition thereof are not specifically limited, the more the protrusions 523, the easier the ring member 52 comes in contact with the field or the like as a point by a protrusion 523. Further, it is preferred to dispose the protrusions 523 so as to have equal intervals therebetween as much as possible, since in such way, the toy top 1 becomes stable due to the weight being in balance and the protrusions are likely to come in contact with the field or the like even if they approach and come in contact with the field or the like from different directions.

Further, although the shape and size of the protrusions 523 are not specifically limited, the sides of the protrusions 523 which come in contact with the ground are formed in the R shape. By making the protrusions 523 have rounded corners in such way, the impact force of the collision when a protrusion 523 come in contact with the field or the like can be alleviated.

The first pillar member 53 and the second pillar member 54 are abutting members which abut the upper side of the shaft tip unit 11.

The first pillar member 53 includes a tube unit 531 whose lower end is opened.

The outer diameter of the tube unit 531 is smaller than the inner diameter of the cylinder 151 of the above-mentioned pressing member 15, and the upper end section of the tube unit 531 of the first pillar member 53 is fit in the cylinder 151.

Although the height position of the upper end of the tube unit 531 in the fitted state is not specifically limited, the height position is set to be higher than the upper end of the cylinder 151 of the pressing member 15.

At the upper end section of the tube unit 531, hooks (the second hooks) 536 which protrude outside in the radius direction are formed at two positions that face each other in the front-rear direction having the axis of the shaft unit 10 therebetween.

The shape of the upper end section of the tube unit 531 corresponds to the shape of the hole 154 which is formed in the ceiling 152 of the pressing member 15, and the upper end section of the tube unit 531 fits in the hole 154 of the pressing member 15 when the tube unit 531 is fit in the cylinder 151.

On the outer peripheral of the tube unit 531 of the first pillar member 53 at the lower section thereof, engaging arms 532 which extend outward in an approximately horizontal manner are formed at two positions that face each other in the left-right direction having the axis of the shaft unit 10 therebetween. The first holes 533 are formed on the base end sides of the engaging arms 532 and the second holes 534 are formed on the free end sides of the engaging arms 532.

The first holes 533 are formed in a rectangular shape which corresponds to the shape of the protrusions 544 of the legs 542 of the after-mentioned second pillar member 54, and the protrusions 544 are inserted in the first holes 533 when assembled. Further, the second holes 534 are formed in a circular shape, and the screws 18 used for engaging the upper case 14 with the lower case 17 are inserted in the second holes 534.

Here, with respect to each engaging arm 532, the first hole 533 and the second hole 534 are connected as one to form a key-hole shaped hole unit in the embodiment. The shape of the holes is not limited to the example shown in the drawing.

Moreover, on the outer peripheral of the tube unit 531 of the first pillar member 53 at the lower section thereof, legs 535 which extend downward are formed on both sides of the engaging arms 532.

With respect to the legs 535, the lower end sections thereof (that is, the free ends of the legs 535) abut the upper end surface of the ring member 52 of the shaft tip unit 11 or they are disposed near the upper end surface of the ring member 52 as shown in FIG. 6A. In such way, the ring member 52 of the shaft tip unit 11 is prevented from being raised upward.

Here, the shape of the legs 535 and the positions and ranges where they are to be disposed are not limited to the example described here.

The second pillar member 54 includes a pillar unit 541 whose upper end is opened and legs 542 which extend outward from the outer peripheral of the pillar unit 541 at the lower section thereof.

The inner diameter of the tube unit 531 of the first pillar member 53 is larger than the outer diameter of the pillar unit 541 of the second pillar member 54, and the pillar unit 541 of the second pillar member 54 is to be fit in the tube unit 531 of the first pillar member 53.

Here, although the pillar unit 541 of the second pillar member 54 is formed as a cylinder shape where inside thereof is hollow is exemplified in the embodiment, the pillar unit 541 is not limited to be hollow inside and it may be solid.

In order to make the toy top 1 lighter, it is preferred that the pillar unit 541 is formed in a cylinder shape where inside thereof is hollow as in the embodiment.

With respect to the pillar unit 541 of the embodiment, the lower end thereof is covered and this lower end abuts the spherical body 51 which is the member that comes in contact with the ground from above. Here, the shape of the part which abuts the spherical body 51 is not limited to the example shown in the drawing.

For example, the lower end of the pillar unit 541 may be formed in a convex shape or an arc shape whose shaft center protrudes toward the spherical body 51 or in contrast, the lower end of the pillar unit 541 may be formed in a concave shape whose shaft center concaves in the direction parting from the spherical body 51 or in an arc shape that fits along the surface of the spherical body 51.

Further, the lower end of the pillar unit 541 may be opened and in such case, the opening end of the pillar unit 541 abuts the spherical body 51.

Moreover, each leg 542 of the second pillar member 54 is formed of a horizontal unit 543 which extends in an approximately horizontal manner from the pillar unit 541 and a protrusion 544 which protrudes upward from the tip (free end) of the horizontal unit 543.

As described above, the protrusions 544 are formed in a rectangular shape which corresponds to the shape of the first holes 533, and the protrusions 544 are inserted in the first holes 533 when assembled.

2. Performance Changing Ring 30

Figure 7A:
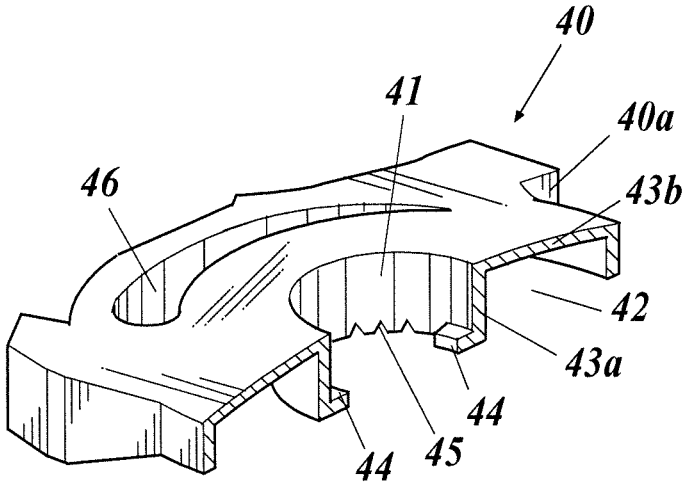
FIG. 7A is a cross-sectional perspective view of a performance changing ring (flywheel)
Figure 7B:
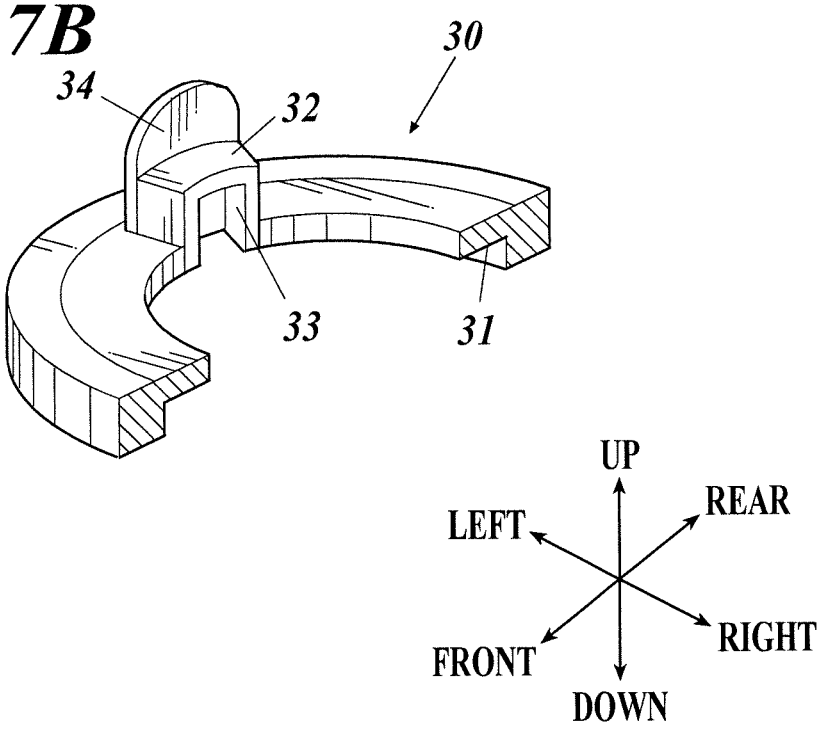
FIG. 7B is a cross-sectional perspective view of a body.

FIG. 7B is a cross-sectional perspective view of the performance changing ring according to the embodiment.

In the embodiment, a flywheel is used as the performance changing ring 30.

The performance changing ring 30 is formed in a plate form.

On the bottom surface of the performance changing ring 30, an annular step 31 which can house the flange 12 of the shaft unit 10 from the lower side is formed.

Further, on the upper surface of the performance changing ring 30, protrusions 32 which protrude upward are formed at two positions that face each other in the left-right direction having the axis of the shaft unit 10 therebetween. At the lower sections of the protrusions 32, recesses 33 which can house the protrusions 141 of the shaft unit 10 from below are formed. Further, on the upper surface of the performance changing ring 30, tongues 34 which extend upward along the outer side of the respective protrusions 32 are formed. The tongues 34 protrude higher than the protrusions 32. Alternatively, the performance changing ring 30 may be constituted by a member that includes a protrusion on the outer peripheral face for facilitating an attack on an opponent's toy top 1 or a member that includes a recess on the outer peripheral face for averting an attack from the opponent's toy top 1. Such a member may be provided instead of or integrally with a flywheel.

3. Body 40

FIG. 7A is a cross-sectional perspective view of the body according to the embodiment.

The body 40 is formed in a disk shape. As shown in FIG. 2, the body 40 includes a base 400 and a transparent cover 401 that is formed in an approximately same shape as the base 400 in the plan view and is placed on the base 400.

On the outer peripheral of the body 40, an uneven pattern 40*a* is formed. Further, at the center of the base 400, a round hole 41 is formed. The transparent cover 401 covers portions other than the round hole 41. In the bottom surface of the body 40, a circular recess 42 is formed which can house the protrusions 32 of the performance changing ring 30 from below.

The circular recess 42 is defined by an inner peripheral wall 43*a*, and two hooks (the first hooks) 44 which protrude inward in the radial direction are formed at the lower end section of the inner peripheral wall 43*a* on the inner peripheral surface thereof at two positions that face each other in the front-rear direction having the axis of the shaft unit 10 therebetween.

Further, on the lower end surface of the inner peripheral wall 43*a*, grooves 45 which engage with the ridges 21 are formed, the grooves 45 being formed by concaves and bumps being formed continuously, at two positions that face each other in the left-right direction having the axis of the shaft unit 10 therebetween.

Further, the circular recess 42 of the body 40 is also defined by a roof wall 43*b*, and arc slits 46 are formed in the roof wall 43*b*, into which the tongues 34 of the performance changing ring 30 can be inserted from below. The arc slits 46 have such a length that allows the tongues 34 to move an adequate distance.

<Assembling Method>

Next, an example of the assembling method of the toy top 1 will be described. Here, it is assumed that the shaft unit 10 is already assembled.

First, the protrusions 141 of the shaft unit 10 are fitted in the recess 33 of the performance changing ring 30 from below so that the shaft unit 10 matches with the performance changing ring 30.

Figure 8A:
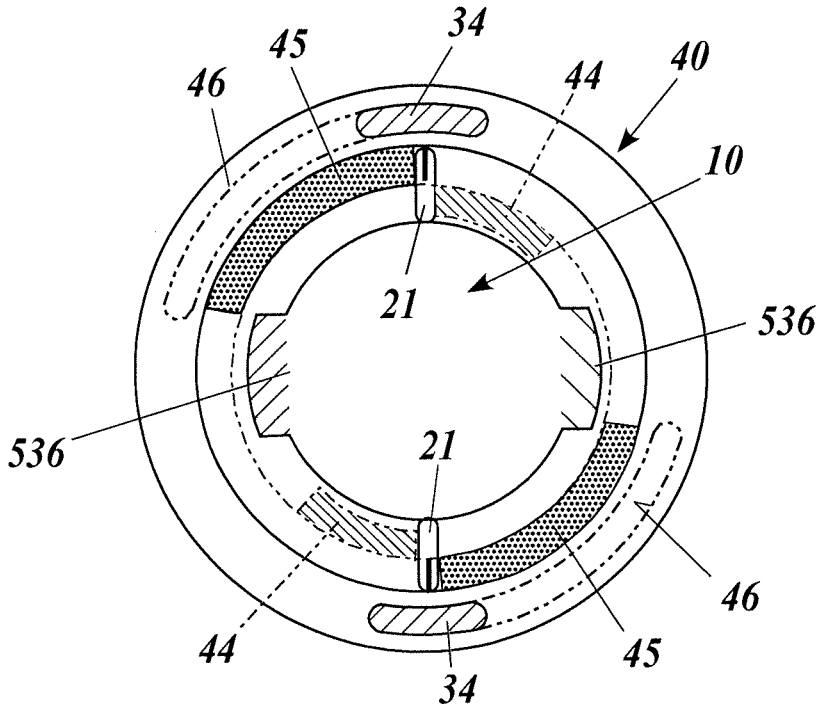
FIGS. 8A and 8B illustrate operation in a state where the shaft unit, body and performance changing ring (flywheel) which form the toy top main body of the toy top according to the embodiment are engaged to each other.

Subsequently, the assembly is brought toward the body 40 from the lower side. In this step, the tongues 34 of the performance changing ring 30 of the assembly are set to predetermined ends of the arc slits 46 of the body 40 (FIG. 8A). In this state, the hooks 536 of the shaft unit 10 do not overlap the hooks 44 of the body 40 in the vertical direction. This state is referred to as a coupling releasable state.

Figure 8B:
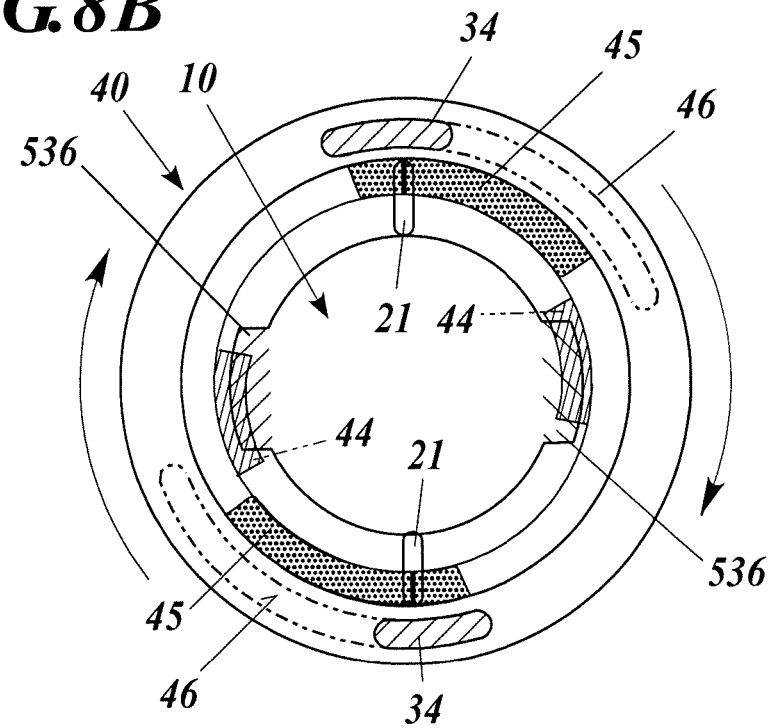

Thereafter, the shaft unit 10 of the assembly is pushed toward the body 40. Then, the performance changing ring 30 firstly abuts the bottom face of the body 40. Further, the spring 16 in the shaft unit 10 shrinks and the hooks 536 of the shaft unit 10 are pushed up higher than the hooks 44 of the body 40. Subsequently, the shaft unit 10 is made to rotate together with the performance changing ring 30 relative to the body 40 until the tongues 34 reach the other ends of the predetermined ends (FIG. 8B). This rotation is a relative rotation of the body 40 relative to the performance changing ring 30 and the shaft unit 10. FIG. 8B illustrates a state in which the body 40 has been already made to rotate relative to the shaft unit 10 and the performance changing ring 30 from the state illustrated in FIG. 8A. After this step, as shown in FIG. 8B, the hooks 536 of the shaft unit 10 are aligned with the hooks 44 of the body 40 in the vertical direction. When the shaft unit 10 is released, the lower surface of the hooks 536 of the shaft unit 10 abuts the upper surface of the hooks 44 of the body 40 by the action of the biasing force of the spring 16.

Such state where the lower surface of the hooks 536 of the shaft unit 10 abuts the upper surface of the hooks 44 of the body 40 is the coupled state. In such way, the shaft unit 10, the performance changing ring 30 and the body 40 are coupled with one another and the toy top 1 is thus assembled.

<How to Play>

Next, an example of how to play with the toy top 1 and operation of the toy top 1 will be described.

In this example, a player spins a toy top 1 to battle with an opponent's toy top 1.

Figure 9:
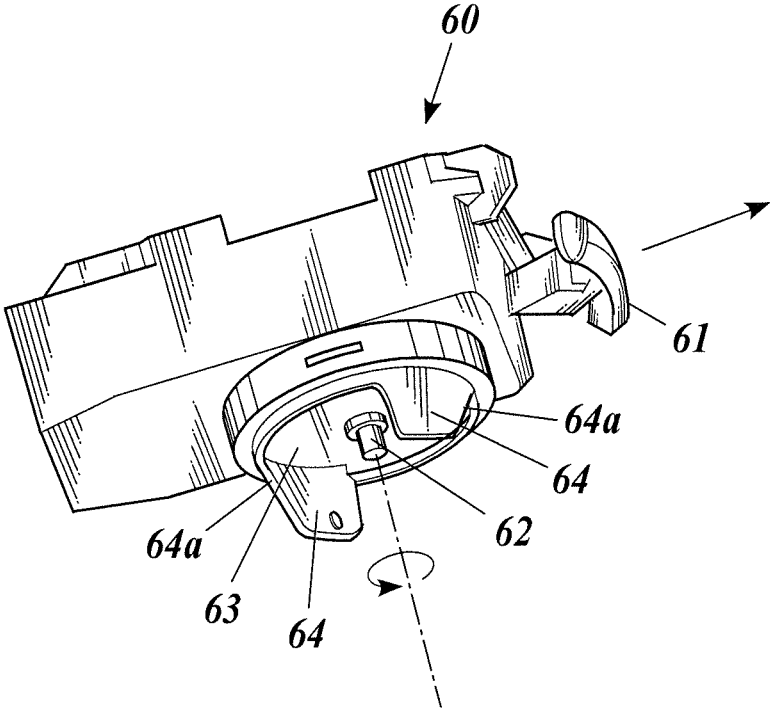
FIG. 9 is a perspective view of an example of a launcher which drives and makes the toy top of the embodiment spin.

In such cases, a launcher 60 as illustrated in FIG. 9 is used to apply a rotary force to the toy top 1. The launcher 60 includes a disk (not shown) therein. The launcher 60 is configured such that when a string (not shown) wound around the disk is pulled by means of a handle 61 while a spiral spring (not shown) biases the disk in a certain rotational direction, the disk is rotated, and a top holder 63 is made to rotate accordingly.

When the toy top 1 is attached to the top holder 63 and the top holder 63 is made to rotate, the rotation of the top holder 63 is transmitted to the toy top 1 through forks 64 that protrude downward, so that the toy top 1 spins. In such case, the forks 64 are inserted in the arc slits 46 of the body 40. Then, when the handle 61 of the launcher 60 is completely pulled, the disk and the top holder 63 stop rotating while the toy top 1 continues rotating by the action of its inertial force. Therefore, the toy top 1 follows the tilted surfaces 64*a* of the forks 64 and detaches from the top holder 63. In FIG. 9, the reference sign 62 denotes a rod that is retractable into the top holder 63. When the toy top 1 is loaded in the top holder 63, the rod 62 is pushed in the top holder 63 by the upper face of the toy top 1. For example, the rod 62 is used for detecting attachment/detachment of the toy top 1.

The toy top 1 thus launched is led to a predetermined field where it spins. When the toy top 1 collides with an opponent's toy top 1, the impact or friction of the collision produces a force that acts in the body 40 in the direction opposite to the spinning direction of the shaft unit 10 and the performance changing ring 30. The body 40 thereby relatively turns in the direction opposite to the spinning direction of the shaft unit 10 and the performance changing ring 30.

Then, the ridges 21 engage with the grooves 45 of the body 40. In such case, the biasing force of the coil spring 16 acts on the ridges 21 and thereby, the shaft unit 10 relatively rotates with respect to the body 40 and their engaging position changes gradually every time the impact force of collision is produced. When the shaft unit 10 reaches the coupling release position, the hooks 44 of the body 40 are released from the hooks 536 of the shaft unit 10 so that the body 40 separates from the shaft unit 10 by the action of the biasing force of the spring 16. Accordingly, the toy top 1 is disassembled as the shaft unit 10, the performance changing ring 30, and the body 40 as illustrated in FIG. 1B.

In the embodiment, since the arc unit 511 of the spherical body 51 which is the member that comes in contact with the ground, the spherical body 51 being supported so as to rotate freely, comes in contact with the field, the resistance that occurs when coming in contact with the ground is smaller comparing to the case where the member that comes in contact with the ground is formed in a rod shape or in a needle shape and the toy top 1 spins smoothly. Further, when the toy top 1 is thrown in to the field or when the toy top 1 collides with an opponent's toy top and bounces off, the ring member 52 comes in contact with the field and brakes are applied when the shaft unit 10 tilts by a predetermined angle or greater. Therefore, the toy top 1 can be prevented from flying out from the field and the toy top 1 which is about to fall can restore its posture by the ring member 52 acting as a support.

Especially, in the case where the field where the game is played is formed in the shape of a mortar being surrounded by a sloped wall, the toy top 1 will climb up the slope when the toy top 1 is thrown in to the field or when the toy top 1 collides with an opponent's toy top and is bounced off. At this time, if the toy top 1 is not provided with the ring member 52, there is a possibility that the toy top 1 will climb up the slope and fly out from the field. With respect to this point, brakes are applied due to the ring member 52 coming in contact with the ground and the toy top 1 can be prevented from flying out from the field.

Moreover, although the spherical body 51 and the ring member 52 are restricted from moving in the up and down directions by being disposed between the lower case 17 and the abutting member, they are not fixated. Therefore, the spherical body 51 and the ring member 52 are not prevented from rotating centering around the axis and the friction resistance that occurs in the rotation direction when the spherical body 51 and the ring member 52 come in contact with the field can be controlled to be small.

Further, since the protrusions 523 are formed at the lower end section of the ring member 52, brakes can be applied due to a protrusion 523 coming in contact with the field as a point when the shaft unit 10 tilts. Therefore, the friction resistance can be controlled to be smaller comparing to the case where the ring member 52 comes in contact with the field as a surface.

<Advantages of the Embodiments>

As described above, according to the embodiment, the spherical body 51 whose part that comes in contact with the ground is the arc unit 511 is adopted as the member that comes in contact with the ground. Therefore, resistance that occurs when the member comes in contact with the field or the like is smaller comparing to the case where the member that comes in contact with the ground is formed in a rod shape or a needle shape and the toy top 1 can spin smoothly for a long period of time.

Further, the spherical body 51 as the member that comes in contact with the ground is supported by the ring member 52. Therefore, brakes are applied due to the ring member 52 coming in contact with the field when the shaft unit 10 tilts by a predetermined angle or greater and the toy top 1 can be prevented from flying out from the field. Moreover, due to the ring member 52 coming in contact with the field, the toy top 1 which is about to fall can restore its posture by the ring member 52 acting as a support. In such way, a toy top which spins stably for a long period of time can be realized.

Furthermore, the ring member 52 itself can also rotate freely independently from the spherical body 51 in the embodiment. Therefore, due to the ring member 52 rotating around the axis even if the ring member 52 comes in contact with the field, the friction resistance that occurs in the rotation direction of the toy top 1 can be controlled to be small and the rotational energy loss in the toy top 1 can be kept to the minimum loss.

Further, in the embodiment, the member that comes in contact with the ground is the spherical body 51 and the ring member 52 supports the spherical body so as to rotate freely by holding the section of the spherical body 51 lower than the center section in the up-down direction. Therefore, the spherical body 51 can be prevented from falling downward, the rotation of the spherical body 51 is not blocked and the friction resistance that occurs when the spherical body 51, which rotates freely, comes in contact with the field can be kept at minimum. Thus, the toy top 1 which continues its smooth rotation for a long period of time can be realized.

Furthermore, in the embodiment, the shaft tip unit 11 is disposed between the lower case 17 which supports the shaft tip unit 11 from below in a movable manner and the abutting member which abuts the upper side of the shaft tip unit 11.

Therefore, even without having an independent shaft receiving member, the shaft tip unit 11 is restricted from moving in up and down directions while maintaining the rotation around the axis and the rotational energy is not easily lost when the spherical body 51 or the ring member 52 which form the shaft tip unit comes in contact with the field. Thus, the toy top which can continue to spin more smoothly for a long period of time can be realized.

Moreover, since the protrusions 523 are formed at the lower end section of the ring member 52 in the embodiment, brakes can be applied by a protrusion 523 coming in contact with the field as a point when the shaft unit 10 tilts. In such way, the friction resistance is smaller comparing to the case where the main body of the ring member 52 comes in contact with the field as a surface and the rotational energy loss can be controlled to be even smaller.

Further, due to a protrusion 523 coming in contact with the field as a point, the rotation is changed and the toy top 1 flies in an unexpected direction. Thus, the game proceeds unexpectedly and the game becomes more interesting.

Moreover, in the embodiment, a plurality of protrusions 523 are formed along the circumference direction of the ring member 52 having approximately equal intervals therebetween. Therefore, the toy top 1 can restore its posture stably even if the shaft unit 10 tilts in different directions.

Furthermore, by having a plurality of protrusions 523, it is expected that the toy top 1 bounces off for several times in complicated ways when the protrusions 523 come in contact with the field. Thus, the game proceeds more unexpectedly and the game can be played without the players losing interest.

Moreover, in the embodiment, the sides of the protrusions 523 that come in contact with the ground are formed in the R shape. Therefore, since the protrusions 523 come in contact with the field more softly comparing to when the protrusions 523 come in contact with the field by their corners, the impact force of the collision can be alleviated and the rotational energy loss can be even smaller.

<Modifications of the Present Invention>

Although an embodiment of the present invention is described above, the present invention is not limited to the embodiment and it is needless to mention that various modifications can be made within the scope of the invention.

For example, in the above described embodiment, an example where the spherical body 51 is provided as the member that comes in contact with the ground is shown. However, the member that comes in contact with the ground is not limited to a spherical body and any member can be adopted as the member that comes in contact with the ground as long as at least a part thereof protrudes downward than the ring member 52.

Further, the member that comes in contact with the ground does not need to be formed in a spherical shape as long as the part that protrudes downward than the ring member 52 is the arc unit 511. For example, the member that comes in contact with the ground where the R is provided at the tip of a rod shaped member as the arc unit can be adopted.

In such way, in the case where the member that comes in contact with the ground includes the arc unit which protrudes downward than the ring member 52, the member comes in contact with the field smoothly similarly to the case where the member that comes in contact with the ground is the spherical body 51. Thus, the toy top can spin stably and it does not easily fall.

Here, it is sufficient that the shaft tip unit 11 includes the ring member which rotates freely centering around the axis of the shaft unit 10 and the member that comes in contact with the ground which is disposed at the center of the ring member and which protrudes downward than the ring member, and the shape of the member that comes in contact with the ground is not specifically limited. For example, the tip of the member may be formed in a cone shape or the like.

In any of the above cases, by disposing the ring member 52 so as to surround the member that comes in contact with the ground, brakes are applied by the ring member 52 coming in contact with the field if the shaft unit 10 tilts by a predetermined angle or greater and the toy top 1 can be prevented from flying out from the field. Further, by the ring member 52 coming in contact with the field, the toy top 1 which is about to fall can restore its posture by the ring member 52 acting as a support.

It is not required to have the protrusions 523 formed at the lower end section of the ring member 52 and the configuration may be made without them.

Although various exemplary embodiments have been shown and described, the invention is not limited to the embodiments shown. Therefore, the scope of the invention is intended to be limited solely by the scope of the claims that follow and its equivalents.

The present U.S. patent application claims priority under the Paris Convention of Japanese Patent Application No. 2016-204640 filed on Oct. 18, 2016 the entirety of which is incorporated herein by reference.

What is claimed is:

1. A toy top, comprising:

a shaft unit whose shaft center is an axis that matches a rotational center; and a shaft tip unit which is provided at a lower end section of the shaft unit, the shaft tip unit including a ring member provided in a movable manner centering around the axis and a member that comes in contact with a ground which is disposed at a center of the ring member and which protrudes downward than the ring member, wherein the shaft unit includes:

a lower case which supports the shaft tip unit from below in a moveable manner and from which a lower end section of the shaft tip unit is exposed; and an abutting member which abuts an upper side of the shaft tip unit.

2. The toy top of claim 1, wherein the member that comes in contact with the ground is a spherical body, and the ring member supports the spherical body by a section lower than a center section of the spherical body in an up-down direction in a rotatable manner.

3. The toy top of claim 2, wherein a protrusion is formed at a lower end section of the ring member.

4. The toy top of claim 2, wherein a plurality of protrusions are formed at a lower end section of the ring member having approximately equal intervals therebetween along a circumference direction of the ring member.

5. The toy top of claim 2, wherein a protrusion is formed at a lower end section of the ring member, and a side of the protrusion that comes in contact with a ground is formed in an R shape.

6. The toy top of claim 1, wherein a protrusion is formed at a lower end section of the ring member.

7. The toy top of claim 1, wherein a plurality of protrusions are formed at a lower end section of the ring member having approximately equal intervals therebetween along a circumference direction of the ring member.

8. The toy top of claim 1, wherein a protrusion is formed at a lower end section of the ring member, and a side of the protrusion that comes in contact with a ground is formed in an R shape.

* * * * *